US007458421B2

(12) United States Patent
Barrow et al.

(10) Patent No.: US 7,458,421 B2
(45) Date of Patent: Dec. 2, 2008

(54) METHODS AND SYSTEMS FOR ROBUST AND ACCURATE DETERMINATION OF WIRELINE DEPTH IN A BOREHOLE

(75) Inventors: Harry Barrow, Girton (GB); Ashley Johnson, Milton (GB); Michael Barrett, Histon (GB); Charles Jenkins, Mawson (AU); John Corben, Colonia Granada (MX); Gary Rytlewski, League City, TX (US)

(73) Assignee: Schlumberger Technology Corporation, Ridgefield, CT (US)

( * ) Notice: Subject to any disclaimer, the term of this patent is extended or adjusted under 35 U.S.C. 154(b) by 207 days.

(21) Appl. No.: 11/300,573

(22) Filed: Dec. 14, 2005

(65) Prior Publication Data

US 2007/0131418 A1 Jun. 14, 2007

(51) Int. Cl.
*E21B 47/04* (2006.01)
*E21B 47/09* (2006.01)

(52) U.S. Cl. ..... 166/255.1; 166/66; 166/77.1; 324/329

(58) Field of Classification Search ..... 166/255.1, 166/65.1, 66.5, 77.1; 702/6; 324/323–329, 324/332–346; 356/5.01–5.15
See application file for complete search history.

(56) References Cited

U.S. PATENT DOCUMENTS

| | | | | |
|---|---|---|---|---|
| 2,934,695 | A * | 4/1960 | Maulsby | 324/221 |
| 4,597,183 | A * | 7/1986 | Broding | 33/701 |
| 4,718,168 | A | 1/1988 | Kerr | |
| 4,722,603 | A * | 2/1988 | Graebner et al. | 356/477 |
| 4,852,263 | A * | 8/1989 | Kerr | 33/735 |
| 5,202,680 | A * | 4/1993 | Savage | 340/853.1 |
| 6,324,904 | B1 | 12/2001 | Ishikawa et al. | |
| 6,543,280 | B2 | 4/2003 | Duhon | |
| 2007/0023185 | A1 * | 2/2007 | Hall et al. | 166/255.1 |

FOREIGN PATENT DOCUMENTS

| | | | |
|---|---|---|---|
| EP | 0651132 | A2 | 5/1995 |
| GB | 2381545 | A | 5/2003 |
| WO | 0054009 | A2 | 9/2000 |
| WO | 00/60780 | A1 | 10/2000 |

* cited by examiner

*Primary Examiner*—David J. Bagnell
*Assistant Examiner*—David Andrews
(74) *Attorney, Agent, or Firm*—Steven Gahlings; James McAleenan; Jody Lynn DeStefanis

(57) ABSTRACT

This invention relates in general to measuring depth of well-tools, such as logging tools or the like, in a borehole. Embodiments of the present invention may provide for disposing transponders along a wireline that may be used to suspend and move the well-tool in the borehole, where the transponders may be disposed along the wireline at predetermined locations. A reader may be located at a reference location and may read when a transponder passes through the reference location and this information may be used to determine the depth of the well-tool in the borehole. Additionally, this invention provides for combining depth measurements from the transponders with measurements from odometer wheels in frictional contact with the wireline and/or time of flight measurements of optical pulses passed along a fiber optic cable coupled with the wireline to accurately and robustly measure the depth of the wireline in the borehole.

15 Claims, 5 Drawing Sheets

METHODS AND SYSTEMS FOR ROBUST AND ACCURATE DETERMINATION OF WIRELINE DEPTH IN A BOREHOLE

This invention relates in general to measuring depth of well-tools, such as logging tools or the like, in a borehole and, more specifically, but not by way of limitation, to the use of passive and/or active agents disposed along a wireline suspending a well-tool in the borehole to determine the depth of the well-tool in the borehole. Additionally, this invention provides for combining depth measurements from the passive and/or active agents with measurements from odometer wheels in frictional contact with the wireline and/or time of flight measurements of optical pulses passed along a fiber optic cable coupled with the wireline to accurately and robustly measure the depth of the wireline in the borehole, wherein the odometer wheels may provide for measurements of the wireline between passive and/or active agents and the time of flight measurements may provide for measuring, among other things, stretch of the wireline.

BACKGROUND OF THE INVENTION

Embodiments of the present invention provide methods and systems for determining depth of a wireline in a borehole penetrating an earth formation. In particular, but not by way of limitation, the invention describes the use of passive and/or active agents—such as radio frequency identification ("RFID") tags, transponders, highly conducting materials, highly conducting regions and/or the like—disposed along the length of the wireline to provide for interaction with and/or response to a device capable of remotely interacting with the passive and/or active agents—such as a transceiver, antenna, signal processing circuit, coil with an applied alternating current and/or the like—to determine the length of the wireline in the borehole. The agents disposed along the wireline may be responsive/reactive to, in effect, provide for communication between the wireline and the remote device. Embodiments of the present invention provide for the use of responsive/interactive agents that are robust and may be coupled with the wireline and in particular, but not by way of limitation, may be coupled under the armoring layer of the wireline to provide that the of responsive/reactive agents maintain their responsiveness/reactiveness when used in the field.

In an embodiment of the present invention, transponders are distributed along the wireline at predetermined intervals. The transponders may communicate with a device configured to interact with the transponders—such as an antenna, transceiver, signal processor circuit or the like—as the transponders pass a measurement point. The measurement point may be any location selected for measuring the movement of the wireline into and/or out of the borehole and the device capable of interacting with the transponder may be configured to provide for the limiting of interaction with only those transponders at the measuring point or in close proximity thereto. In some embodiments, the transponders may be either passive or active RFID tags and the interaction device may be a radio frequency transceiver, antenna combined with a signal processor and/or the like. In other embodiments, materials with electrical conductivity higher than the wireline—i.e., copper, gold, silver, highly conducting metals or the like—or regions of the wireline treated to have highly electrically-conducting properties—may be disposed along the length of the wireline to provide for interaction with the interactive device—which may be a coil of conductive wire supplied with an alternating current. For purposes of this invention the terms "conducting" and "electrically conducting" may be used interchangeably.

In certain aspects, the highly conductive materials and/or highly conductive regions may be grouped together and logically arranged on the wireline to provide for communication of information from the wireline to the interactive device. The information stored in the grouping/arrangement of the highly conductive materials and/or highly conductive regions may uniquely identify the group of highly conductive materials and/or highly conductive regions to the interactive device and/or a distance from a specific location on the wireline to the position of the group of highly conductive materials and/or highly conductive regions. In other aspects, the responsive/interactive agents on the wireline may be RFID tags that may store and provide data to the interactive device—such as a unique RFID tag identification and/or the distance from a specific location on the wireline to the position of each of the RFID tags. In some embodiments, the transponders, conducting material/regions and/or the like may be disposed along the wireline when the wireline is under tension/temperature conditions that may mimic the conditions for the wireline when used in practice.

In certain embodiments of the present invention, measurements from the passive and/or active agents may be combined with measurements from an odometer wheel and/or a set of odometer wheels in frictional contact with the wireline. In such embodiments, distances between the locations of the passive and/or active agents located on the wireline may be determined. In further embodiments, the wireline may be configured to include a fiber optic cable in combination with the passive and/or active agents. As such, time of flight measurements of an optical pulse passed down the fiber optic may be measured and stretch of the wireline may be measured. In yet further embodiments, measurements from the passive and/or active agents and stretch measurements from the time of flight of the optical beam may be combined with measurements from the odometer wheel(s) to provide a system for measuring wireline depth in the borehole that may be both robust and accurate.

BRIEF DESCRIPTION OF THE DRAWINGS

The present invention is described in conjunction with the appended figures.

Figure 1:
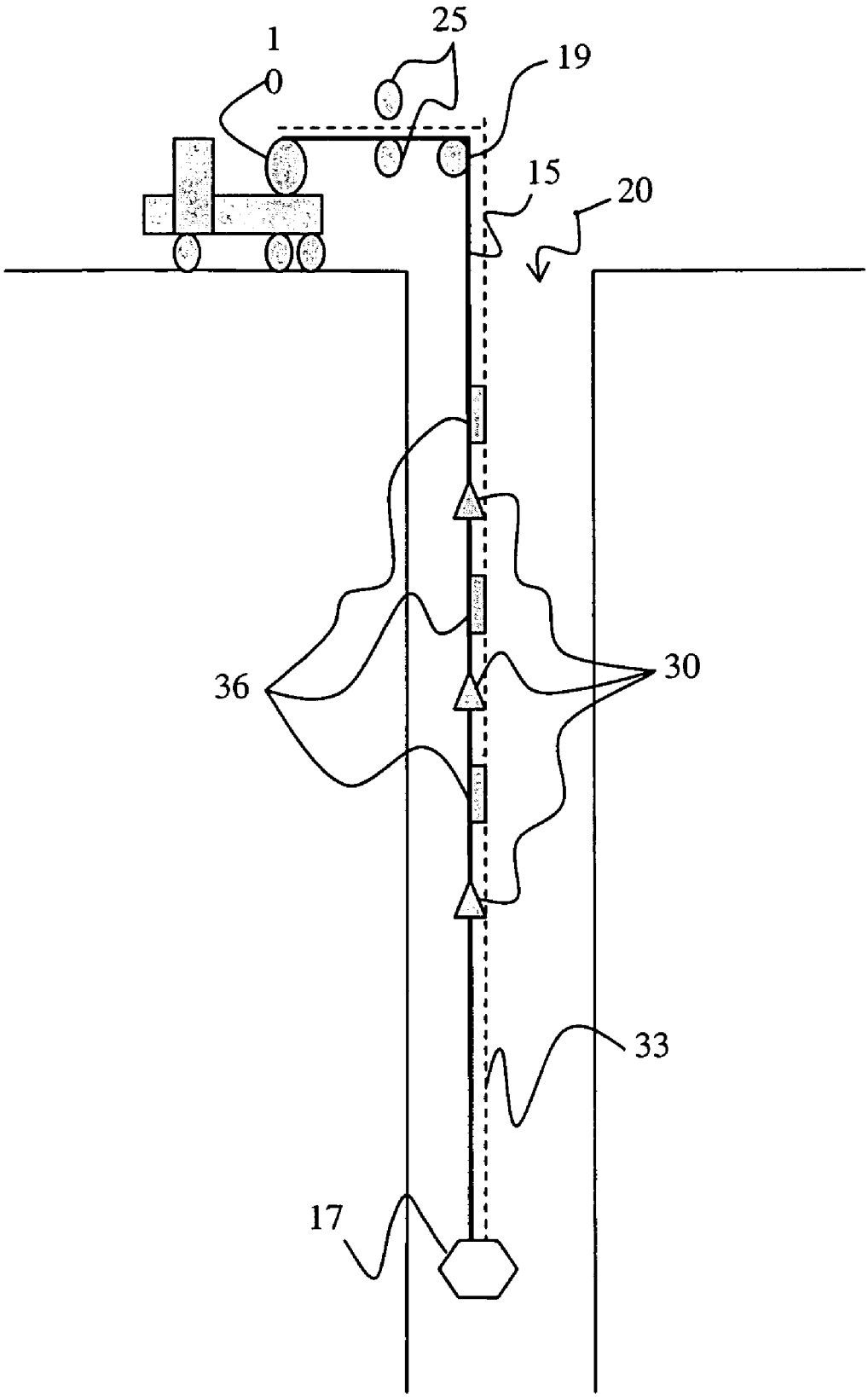
FIG. 1 is a schematic-type illustration of a wireline coupled with radio-frequency identification tags and an optical fiber, wherein the wireline contacts an odometer wheel system and may be used to suspend a well-tool in a borehole, in accordance with an embodiment of the present invention.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION OF THE INVENTION

Embodiments of the present invention provide methods and systems for determining depth of a wireline in a borehole penetrating an earth formation. In particular, but not by way of limitation, the invention describes the use of passive and/or active agents—such as radio frequency identification ("RFID") tags, transponders, highly conducting materials, highly conducting regions and/or the like—disposed along the length of the wireline to provide for interaction with and/or response to a device capable of remotely interacting with the passive and/or active agents—such as a transceiver, antenna, signal processing circuit, coil with an applied alternating current and/or the like—to determine the length of the wireline in the borehole. The agents disposed along the wireline may be responsive and/or reactive to provide for communication between the wireline and the remote device. Embodiments of the present invention provide for the use of responsive/interactive agents that are robust and may be coupled with the wireline and in particular, but not by way of limitation, may be coupled under the armoring layer of the wireline to provide that the responsiveness of the agents is maintained by the responsive agents when used in the field. Furthermore, in certain embodiments of the present invention, the passive/active agent measuring system may be combined with an odometer wheel system and/or a fiber optic measuring system to measure wireline depth in the borehole.

Specific details are given in the following description to provide a thorough understanding of the embodiments. However, it will be understood by one of ordinary skill in the art that the embodiments maybe practiced without these specific details. For example, circuits may be shown in block diagrams in order not to obscure the embodiments in unnecessary detail. In other instances, well-known circuits, processes, algorithms, structures, and techniques may be shown without unnecessary detail in order to avoid obscuring the embodiments.

Also, it is noted that the embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed, but could have additional steps not included in the figure. A process may correspond to a method, a function, a procedure, a subroutine, a subprogram, etc. When a process corresponds to a function, its termination corresponds to a return of the function to the calling function or the main function.

Furthermore, embodiments may be implemented by hardware, software, firmware, middleware, microcode, hardware description languages, or any combination thereof. When implemented in software, firmware, middleware or microcode, the program code or code segments to perform the necessary tasks may be stored in a machine readable medium such as storage medium. A processor(s) may perform the necessary tasks. A code segment may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, etc.

FIG. 1 is a schematic-type illustration of a wireline coupled with radio-frequency identification tags and an optical fiber, wherein the wireline contacts an odometer wheel system and may be used to suspend a well-tool in a borehole, in accordance with an embodiment of the present invention. Referring now to FIG. 1, a truck winch 10 or the like may be used to wind or unwind an armoured wireline 15 into and out of a borehole 20. In certain aspects, the armoured wireline 15 may be coupled with a well-tool 17 and provide for the movement of the well-tool 17 in the borehole 20. Positioning of the well-tool 17 in the borehole 20 may be provided by a positioning wheel 19 or the like configured to maneuver the well-tool 17 in the borehole 20.

In an embodiment of the present invention, one or more odometer wheels 25 may be used to frictionally engage the surface of the armoured wireline 15 and may provide for the turning of the odometer wheels 25. The turning of the odometer wheels 25 may provide for generation of an electrical output, data signal or the like and this output/signal may be representative of the length of the armoured wireline 15 passing in contact with the odometer wheels 25. In certain aspects, the odometer wheels 25 may measure the length of the armoured wireline 15 entering the borehole 20 and/or the length of armoured wireline 15 exiting the borehole 20.

The odometer wheels 25, although capable of direct measurement of the armoured wireline 15 passing in frictional contact with the odometer wheels 25, may not provide for accurate measurements. The odometer wheels 25 may wear and may chatter or slip in use which may in turn increase the length measurement made by the odometer wheels 25. Additionally, build-up of materials on the wheel surface and stuck or hot bearings can cause the wheels to reflect a decrease in the length measurement.

A plurality of RFID tags 30 may be disposed along the length of the armoured wireline 15 and may be detected as they pass by a detector (not shown). The detector may be located at the mouth of the borehole 20 or at any other reference position an operator may choose as a reference point for making determinations of the length of the armoured wireline 15 passing the reference point, i.e., the reference point may be a location at a known distance from the mouth of the borehole 20 or the like. The detector may in certain aspects read an identification signal from each of the RFID tags 30 and this identification signal may be passed to a processor (not shown) and the identification signal compared with a database to determine a position of each of the RFID tags 30 on the armoured wireline 15. The position of the RFID tags 30 on the armoured wireline 15 detected by the detector may be used to determine the length of the armoured wireline 15 in the borehole.

In an embodiment of the present invention, a fiber optic cable 33 (shown, merely for schematic purposes, as being separate from the armoured wireline 15) may be incorporated into and/or combined with the armoured wireline 15. In certain aspects of the present invention, an optical pulse may be transmitted along the fiber optic cable 33 and the length of the armoured wireline 15 may be evaluated with accuracy from the detected time of flight of the optical pulse and the light speed of the optical pulse in the fiber optic. In certain aspects, the optical pulse may be transmitted down the fiber optic cable 33, reflected back from an end of the fiber optic cable 33 proximal to the well-tool 17 and detected at a detector located at a reference point. From the time of flight of the optical pulse and the locations of the point the optical pulse is applied to the fiber optic cable 33 and the location of the reference point, the length of the armoured wireline 15 in the borehole 20 may be determined.

The optical speed of the optical pulse in the fiber optic cable 33 is dependent upon the temperature of the fiber optic cable 33 and the local strain on the fiber optic cable 33. Distributed temperature sensing ("DTS") techniques may be used to determine temperatures affecting the fiber optic cable 33 in the borehole 20 and temperature correction factors corresponding to the sensed temperatures may be used to correct the time of flight measurements for temperature effects. In fact, the fiber optic cable 33 may itself be used as a DTS system since backscatter of the optical pulse traversing the fiber optic cable 33 may have temperature dependent characteristics and may be measured at locations along the fiber optic cable 33 for temperature analysis. Strain correction factors may be determined experimentally and/or theoretically according to various factors including the weight of the well-tool 17, the dimensions of the armoured wireline 15 and/or the like. A processor (not shown) may receive the time of flight measurement of the optical pulse and data from the odometer wheels 25 and/or the RFID tags 30 and may process the length of the armoured wireline 15 in the borehole, the stretch of the armoured wireline 15 and/or the like.

Time of fight of the optical pulse along the length of the armoured wireline 15 may only provide for a determination of the total length of the fiber optic cable 33. As such, to obtain additional data, a series of gratings 36 may be disposed along the length of the armoured wireline 15. In this way, time of flight of optical pulses traveling over segments of the armoured wireline 15 may be measured and the length and/or stretch of these segments may be derived from the time of flight over the segment, and the measurement of the segment length obtained from the odometer wheels 25 and/or the RFID tags 30. In certain aspects, the gratings 36 may be located at 1000 ft intervals along the armoured wireline 15. The RFID tags 30 may be positioned along the armoured wireline 15 at contemporaneous locations with the gratings 36 to provide a system wherein the location of the gratings 36 on the armoured wireline 15 may be determined by detecting the RFID tag located with the grating.

The length of the armoured wireline 15 from the earth's surface to the well-tool 17 may be affected by a number of factors. Merely by way of example, factors affecting length of a cable are elastic stretch of the cable (non-permanent stretch), permanent stretch of the cable and stretch due to the temperature of the cable. Elastic stretch is principally a function of tension. Thus, for a given cable size and construction, elastic stretch can be determined empirically by tensioning a cable and physically measuring the change in length for elastic stretch as a function of tension. Stretch formula's and tables correlating elastic stretch as a function of tension are known and may be used to calculate elastic stretch as a function of tension. Permanent stretch may be corrected for by cycling the cable under tension a sufficient number of times to stabilize the cable length and eliminate the permanent stretch prior to using the cable and/or applying the RFID tags 30 and/or the gratings 36. However, a cable may undergo further permanent stretch if a well-tool or the like with a mass greater than the cycled mass is applied to the cable. Stretch as a function of temperature may also be determined empirically by heating a cable to various temperature levels, applying tension and determining the stretch values for a cable as a function of temperature and tension. These techniques for determining stretch may be used in the processing of the length of the armoured wireline 15. However, in embodiments of the present invention combining measurements from the odometer wheels 25, the fiber optic 33 and the RFID tags 30, these approximations of stretch may not be necessary and more accurate wireline length and stretch determinations may be possible without the use of estimated correction factors.

Figure 2:
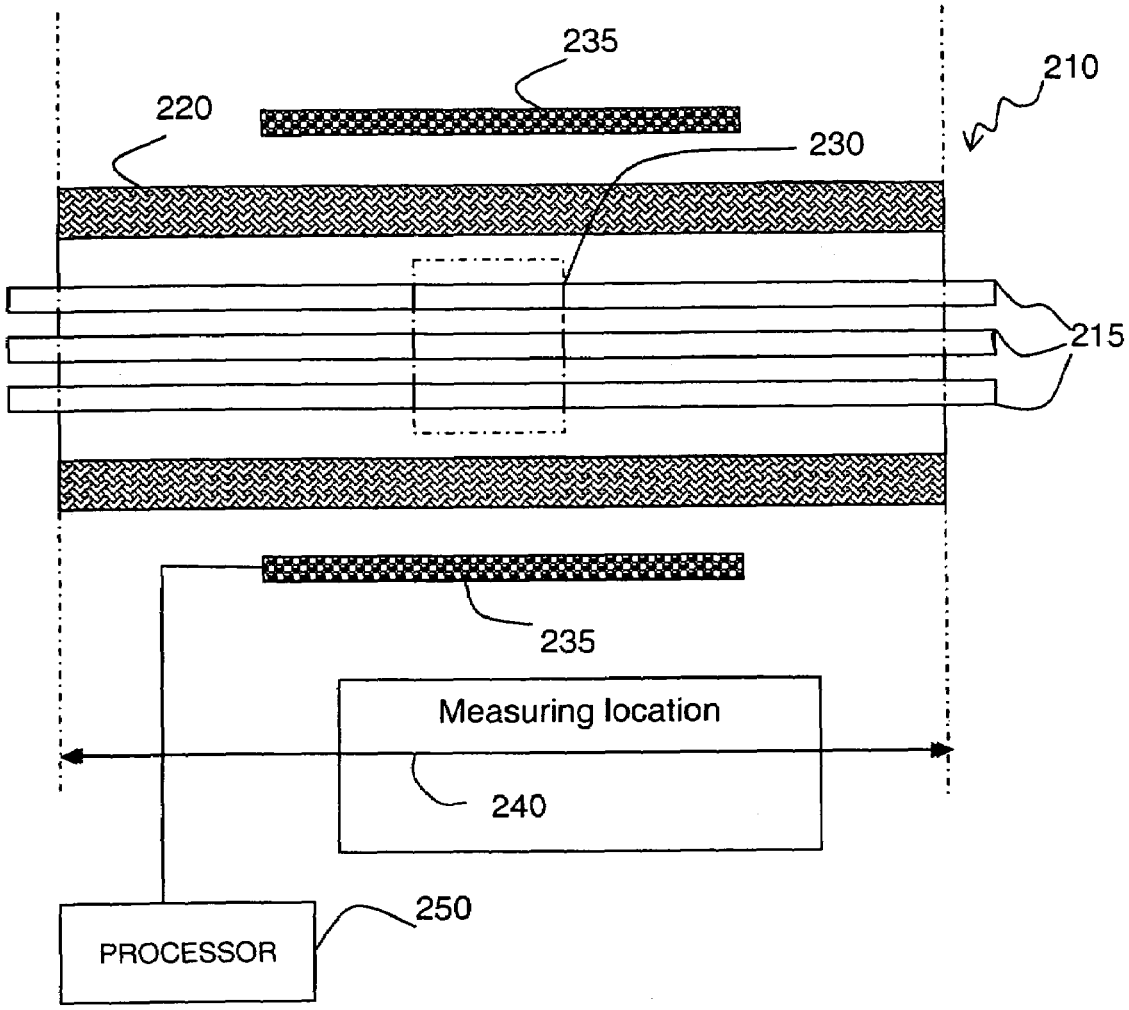
FIG. 2 is a block diagram of an armored wireline coupled with a responsive agent and a reader configured to interact with the responsive agent, in accordance with an embodiment of the present invention.

FIG. 2 is a block diagram of an armored wireline coupled with a responsive agent and a reader configured to interact with the responsive agent in accordance with an embodiment of the present invention. As illustrated, a wireline 210 comprises a plurality of cable strands 215 surrounded by an armoring layer 220. In exploration and/or development of hydrocarbon wells an operation known as well logging is often undertaken. In the well-logging operation, one or more well-tools (not shown) may be lowered into a borehole (not shown) on the end of the wireline 210 to determine properties of the borehole, surrounding earth formations and/or the like. In such operations, the wireline may contain electrical connections or the like (not shown) to provide for the transfer of information from the well-tool to a data acquisition system at the surface and may also provide for the passage of power and/or data from the surface to the well-tool. The wireline may be moved through the borehole by the use of a winch drum (not shown) and as such may provide for the movement of the well-tool through the borehole. The well-tool may be drawn through the borehole and continuous measurements may be taken. The well-tool may also be moved to areas of interest in the borehole for study of the surrounding earth formation(s). When the tool is positioned at an area of interest one of the desirable parameters to be determined may be depth of the well-tool in the borehole.

In fact, the measured depth of the well-tool—the position of the logging tool measured along the borehole—may very often be the most important parameter measured in the well-logging procedure. The cable strands 215 may provide the strength of the wireline 210 and the armoring layer 220 may protect power lines, communication lines and/or the like in the wireline 210 during the use of the wireline in the borehole. As described above, the armoring layer 220 protects components of the wireline and methods and systems that apply markings or the like to the armoring layer 220 for depth measurement purposes cannot provide robust measurement of wireline depth because such marking are likely to deteriorate when the wireline is used.

In an embodiment of the present invention, a responsive agent 230 may be coupled with the wireline 210. The responsive agent 230 may be an object, material and/or integrated region of the wireline 210 that is responsive—i.e., provides a measurable effect—when proximal to and/or in the field of an alternating electrical current, light, sonic waves, radio-frequencies and/or the like. In certain aspects, the responsive agent may be an RFID tag, an area on the wireline 210 or a substrate coupled with the wireline 210 that has conductivity higher than the material composing the wireline 210 and/or the like. The responsive agent 230 may be positioned under the armoring layer 220 and or coupled with the armoring layer 220. When located below the armoring layer 220 the responsive agent 230 is protected when the wireline is used in the borehole. However, robust responsive agents—such as RFID tags, transponders or the like may also be capable of robust use, without deterioration of response properties or the like—when securely coupled with the armoring layer 220

In embodiments of the present invention a reader 235 is positioned at a measuring location 240. The reader 235 may be a transceiver (transmitter/receiver), a coil of conducting wiring, a light emitter/receiver, sonic wave producer/receiver and/or the like. Optimal positioning of the reader 235 relative to the wireline 210 may depend upon the type of the reader 235 and the type of the responsive agent 230. Merely by way of example, for combinations in which the reader 235 is a radiofrequency transceiver and the responsive agent 230 is an RFID tag or the reader 235 is a coil of conductive wiring and the responsive agent 230 is a conductive material or region, the positioning of the reader 235 relative to the wireline 210 may be of the order of meters or less. As illustrated in FIG. 1, the measuring location 240 may define an area around the wireline 210. This area may be greater or smaller depending upon the physical characteristics of the reader 235 and the responsive agent 230 and/or the strength and/or focus of the medium used to read the responsive agent 230.

An RFID tag is an electronic device that may incorporate specific and typically unique data. The data stored on the RFID tag may be read by an interrogating radio frequency transceiver system. The RFID tag—that are often referred to and are herein referred to interchangeable as transponders—may be active objects—powered by a battery or the like—or passive objects that acquire the energy to respond to a read interrogation from the transceiver from a radio frequency field applied to the RFID tag from the transceiver. Passive RFID tags may be smaller and have fewer components then active RFID tags. However, to provide sufficient energy to a passive RFID tag for operation purposes the transceiver and passive RFID tag must generally be positioned from about one centimeter to one meter apart.

Typically, RFID tags consist of an antenna or a coil that may be used to collect radio frequency energy for operating the RFID tag from an incident radio frequency field and an integrated circuit that may have memory capable of storing data. As such, the RFID tag may be activated by a radio-frequency field and when the RFID tag enters the radio-frequency field and, in response to the activating radio frequency field, the RFID tag may emit data stored on the RFID tag in the form of a radio frequency emission that may be detected by the activating transceiver. Commercially available passive RFID tags generally operate at low frequencies, typically below 1 MHz. Low frequency tags usually employ a multi-turn coil resulting in an RFID tag having a fairly substantial thickness. High frequency, passive RFID tags, however, operating at frequencies of the order of 1-10 GHz, may consist of a single turn coil or even a flat antenna and, as such, may be very compact.

In certain embodiments of the present invention, the responsive agent 230 may be an RFID tag that may be coupled with the wireline 210. In certain aspects, the RFID tag may be positioned below the armoring layer 220 to provide for protection of the RFID tag when the wireline 210 is used in the borehole. In certain aspects, a plurality of the RFID tags may be coupled along the length of the wireline 10 at measured intervals. Merely by way of example, for accurate location of the RFID tags, the wireline may be measured under a tension proportional to the tension to be produced when the well-tool is coupled to the wireline 210 and manipulated in the borehole. By providing that each of the RFID tags store a unique data sequence, when the wireline 210 is moved in to and out of the borehole during the manipulation of the well-tool, the RFID tags move in and out of the measuring location 240, proximal to the reader 235, the RFID tags are read by the reader 235 and the information received by the reader 235 may be provided to a processor 250 that may be configured to determine depth of the well-tool in the borehole from the pre-measured interval between the RFID tags, the received RFID tag data, the position of the measuring location 240 relative to the borehole and/or the like. The processor 250 may be associated with a database may compare the data received from the RFID tag with the database to determine the exact position on the wireline 210 of the RFD tag passing through the measuring location 40.

In some embodiments of the present invention, the RFID tags may be positioned along the length of the wireline 210 and each of the RFID tags may directly store data regarding the location of the RFID tag relative to an end of the wireline 10 or a specific location on the wireline 210. Alternatively, each RFID tag may store a unique identification and each of the RFID tags may be disposed at predetermined intervals along the wireline. In a well logging operation, a toolstring including one or more tools may be lowered into a borehole on the end of the wireline 210 which connects the tool to an acquisition system at the surface and provides power and/or data from the surface.

As discussed above, the wireline 210 may be manipulated in the borehole by means of a winch drum. In previous wireline measurement methods, depth of the well-tool in the borehole has been assessed by means of a measurement or odometer wheel. In such depth measurement methods, the odometer wheel or odometer wheels is positioned proximally to the cable drum and the wireline 210 passes from the winch drum over the odometer wheel and into the borehole. When the wireline passes over the odometer wheel it causes the odometer wheel to turn and measurement of the rotation of the measurement wheel, therefore, provides information about the amount of wireline passing over the odometer wheel and into the borehole. There are, however, many problems, as discussed above, with simply using an odometer wheel to calculate depth of the well-tool in the borehole, such as the odometer wheel may slip, the odometer wheel may wear and, as a result change in diameter, the odometer wheel may acquire deposits such as mud and/or tar on its active. surfaces, and/or the like. In some embodiments of the present invention, an odometer wheel (not shown) may be used in combination with the reader 235 and the responsive agent 230 to provide for measurement of the wireline 210 between responsive agents 230 positioned along the wireline 210. In this way, the information from the responsive agent 230 and the odometer wheel may be combined for robust/accurate wireline depth determinations. As may be apparent to persons of skill in the art, inaccuracies due measurements from an irregularly functioning and/or slipping odometer wheel for short measurements of the wireline 210 may be compensated for and/or removed in a system utilizing responsive agents in combination with the odometer wheel.

In certain embodiments, a fiber optic may be coupled with the wireline 210 and optical pulses may be transmitted down the optical fiber to determine wireline length. By placing gratings at known distances along the wireline 210, time of flight measurements of an optical pulse traveling between the gratings may be converted to length measurements and compared with the predetermined length to determine stretch of the wireline 210 under the applicable operating conditions.

In some embodiments of the present invention, the responsive agents 230 may be substrates and/or regions of the wireline 10 with an electrical conductivity greater than the wireline 210 and the reader 235 may be a coil of electrically conducting wire and or the like. In certain aspects, the responsive agents 230 may be a band or tube of highly conducting material. Merely by way of example, the responsive agent 230 may comprise of copper foil wrapped around the wireline with a low resistance contact where the copper foil overlaps. The band or tube of highly conducting material may be wrapped around the wireline and positioned beneath the armor shield 220. For manufacturing purposes, an insulating tape containing short sections of conducting material may be wound around the wireline in such a manner that the sections of conducting material are spaced at intervals along the wireline 210 and wherein the wrapping of the wireline is performed so that length of the intervals between the conducting sections is a known distance. The wrapping may also be done to provide that the armoring layer 220 is located above the wrapping.

In embodiments of the present invention in which the responsive agents 230 are conducting materials and/or conducting areas of the wireline 210, the reader 235 may be a coil of conducting wire or the like that may be attached to an alternating current source (not shown). During operation of the well-tool the wireline 10 may be passed through or proximally to the reader 235 at the measuring location 240. In such embodiments, the reader 35 and the responsive agents 30 may form a simple transformer where the secondary winding, the conductive band is short circuited. When the responsive agents 230 are removed from the reader 235, the reader 235 may behave as an inductor and may have a high impedance. When the wireline 210 passes through the reader 235, the reader 235 and the responsive agent 230 may become coupled and the impedance of the reader may be reduced. In such embodiments, by monitoring the impedance of the reader 235, the processor 250, a detector and/or the like may be capable of determining/detecting when the responsive agent 230 is present at the measuring location 240. By spacing the conducting materials and or conducting regions of the wireline at regular known intervals along the wireline 210 and feeding the output of the reader 235 to the processor 250 the length of the wireline 210 in the borehole may be determined. Further, by using an odometer wheel in combination with such a system, the depth of the well-tool in the borehole may be determined in an accurate and robust manner.

Figure 3:
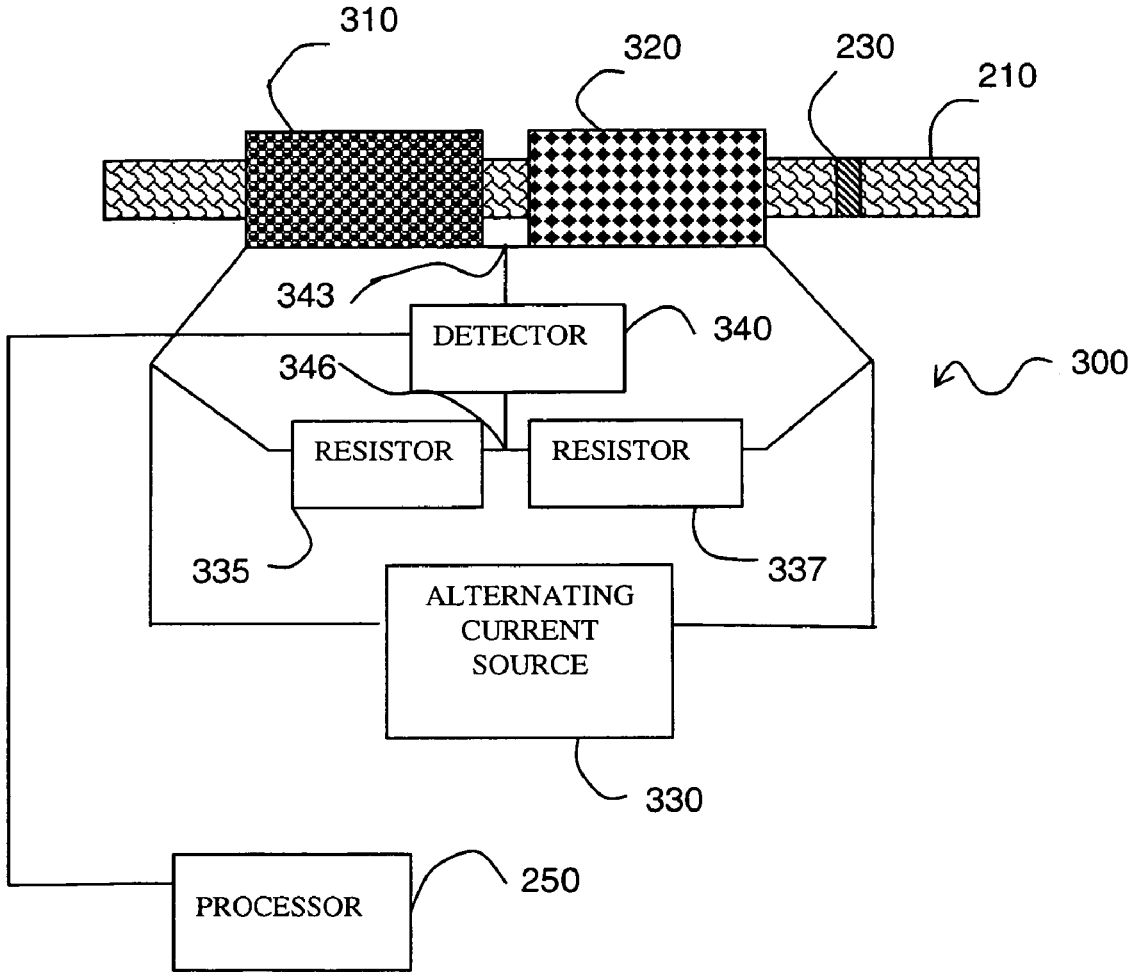
FIG. 3 is a block diagram of a reader for detecting and/or reading responsive agents distributed along a wireline, in accordance with an embodiment of the present invention.

FIG. 3 is a block diagram of a detector for detecting responsive agents distributed along a wireline in accordance with an embodiment of the present invention. In the illustrated embodiment, the responsive agent 230 may be an electrically conducting material coupled with the wireline 210 and/or an electrically conductive area configured on a substrate of the wireline 210 with a conductivity higher than the wireline 210. The detector 300 may comprise a first coil of conducting material 310 and a second coil of conducting material 320. The first coil of conducting material 310, a second coil of conducting material 320 and the wireline 210 may be configured to provide that the wireline 210 passes through the first coil of conducting material 310 and the second coil of conducting material 320. An alternating current source 330 may be coupled with the first coil of conducting material 310 and the second coil of conducting material 320 with a pair of resistors—resistor 335 and 337 —comprising a bridge electrical circuit with a detector 340 positioned in the bridge circuit between the first coil of conducting material 310 and the second coil of conducting material 320.

In the illustrated embodiment, when none of the responsive agent 230, which herein may be a highly conductive material and/or region, is present inside the area bounded by either the first coil of conducting material 310 or the second coil of conducting material 320, a first voltage in the bridge circuit at a first circuit location 343 is the same as a second voltage at a second circuit location 346. When the responsive agent 230 is located within the area inside the first coil of conducting material 310, the impedance of the first coil of conducting material 310 is reduced and the first voltage and the second voltage become unbalanced and detector 340 registers an output value. When the responsive agent 230 is located within the area inside the second coil of conducting material 310, the impedance of the second coil of conducting material 310 is reduced and the first voltage and the second voltage become unbalanced and detector 340 registers an output value that is equal in value but the inverse of the value when the responsive agent 230 is located within the area inside the first coil of conducting material 310. Further, when the responsive agent 230 is exactly at the midpoint between the first coil of conducting material 310 or the second coil of conducting material 320 the output signal from the detector is 340. By communicating the output from the detector 340 to the processor 250 a precise location of the responsive agent 230 may be determined. From the precise location of the responsive agent 230 along with a known separation interval between a plurality of the responsive agents 230 depth of a well-tool attached to the wireline 210 may be determined with accuracy and this accuracy may be increased by the use of an odometer wheel as disclosed above.

Figure 4:
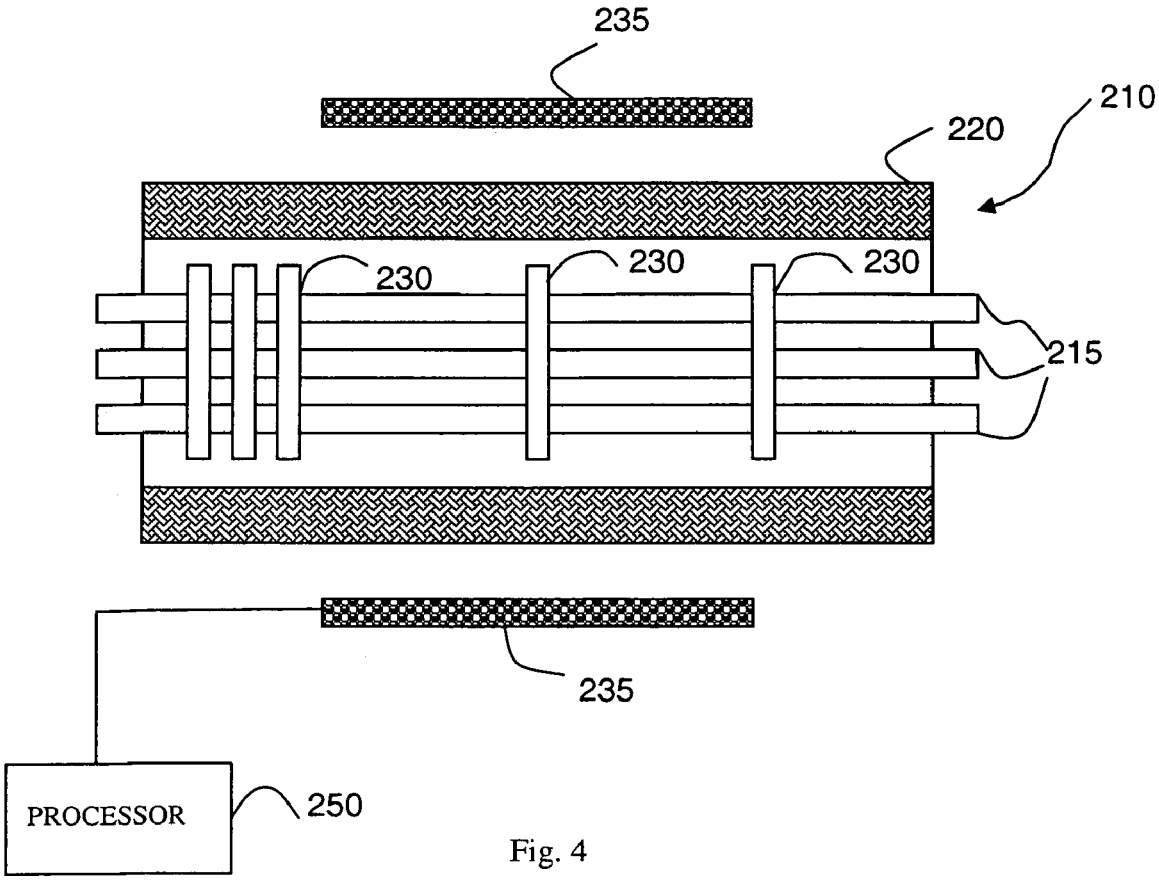
FIG. 4 is a block diagram of an armored wireline coupled with a plurality of responsive agents arranged logically on the wireline and a reader configured to interact with the plurality of responsive agents, in accordance with an embodiment of the present invention.

FIG. 4 is a block diagram of an armored wireline coupled with a plurality of distance information agents arranged logically on the wireline and an agent reader coil in accordance with an embodiment of the present invention. In embodiments of the present invention, the responsive agents 230 may be arranged logically along the wireline 210 and may, as such, provide information to the reader 235. In the illustrated embodiment that responsive agents 230 are arranged to encode binary information. Using such arrangements, electrically conductive materials and/or regions of the wireline 210 with enhanced electrical conductive compared to the substrates comprising the wireline 210 may be used in embodiments of the present invention instead of RFID tags to communicate information to the reader 235 other than simply the information that the responsive agent is proximal to the reader 235. In such embodiments, the processor 250 may be used in combination with the reader 235 and the wireline 210 to ascertain depth of the wireline in the borehole by decoding the information stored on the wireline 210 in the form of logically arranged highly-electrically-conducting regions on the wireline 210 where the logical arrangement contains information regarding the location on the wireline 210 relative to an end of the wireline. Depth analysis measurements may be enhanced by passing the wireline 210 over odometer wheel as disclosed above.

Figure 5:
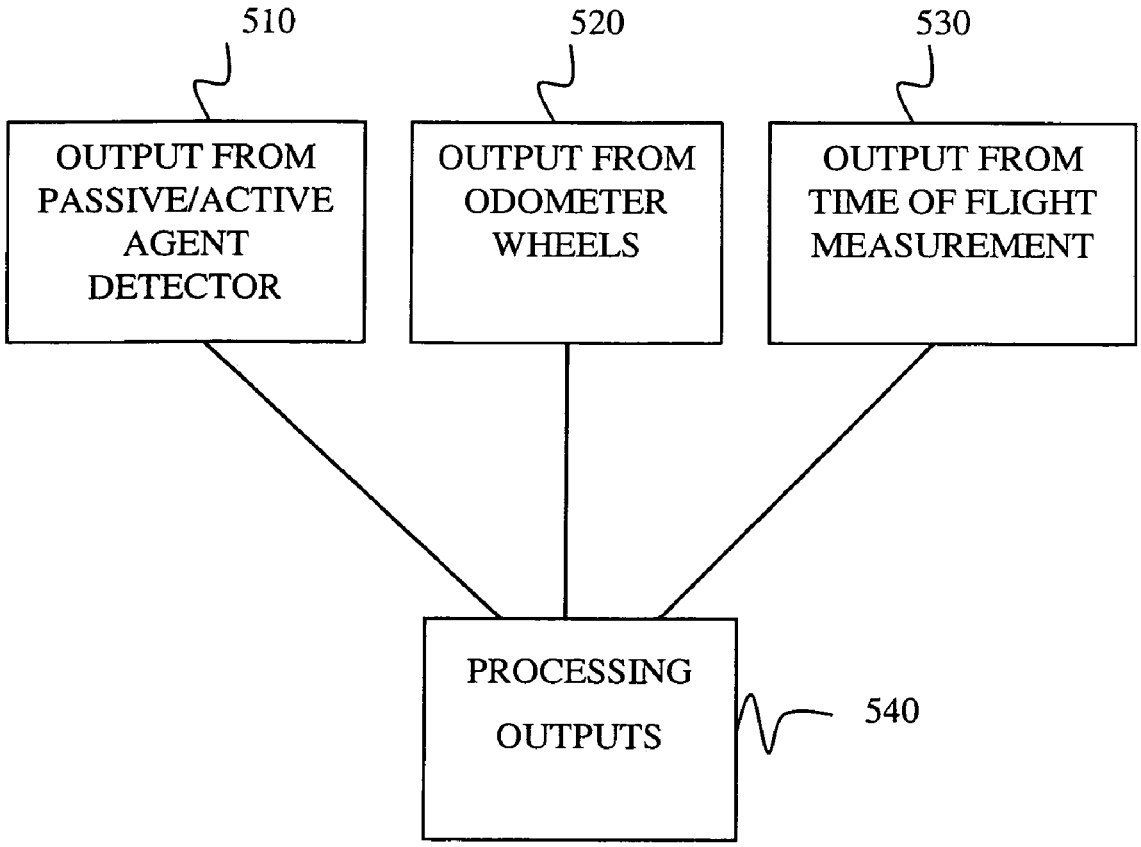
FIG. 5 is a flow-type diagram of measuring wireline depth, in accordance with an embodiment of the present invention.

FIG. 5 is a flow-type diagram of measuring wireline depth in accordance with an embodiment of the present invention. In an embodiment of the present invention, the wireline may be coupled with a fiber optic and a plurality of passive/active agents and may be passed into the borehole with frictional contact with an odometer wheel system. A reference point relative to the borehole may be selected and a detector for detecting the passive/active agents may be positioned in proximity to the reference point or at a known position relative to the reference point. In step 510 when the wireline is moved and one of the plurality of the passive/active agents passes the detector, the detector provides an output.

In step 520, as the wireline is moved inside the borehole it is in frictional contact with an odometer wheel system and the odometer wheel moves rotationally in response to the frictional contact. As a result of the rotating of the odometer wheel an electrical signal or the like may be generated as an output from the odometer wheel system. In step 530, an optical signal may be transmitted down an optical fiber that is coupled with the wireline and a time of flight measurement may be output. In certain aspects, the optical signal may travel down the length of the optical fiber on the borehole side of the reference point or it may transmitted down the fiber optic and/or detected at locations with known distances from the reference point. Time of flight of the optical beam, wherein the time of flight is the time for the optical beam to traverse the length of the wireline in the borehole may be measured. In other aspects, the optical signal may be detected at various positions along the wireline by the use of optical gratings or the like. In such aspects, time of flight over lengths of the wireline, which may be predetermined lengths, may be measured and provided as an output. The time of flight may be compared with a theoretical time of flight that the optical signal should have produced for the predetermined length of wireline under the applicable conditions on the fiber optic, such as temperature and stress, to determine stretch of the wireline.

In step 530, a processor may process the outputs from the passive/active-agent detector, the odometer wheels and the fiber optic cable to determine the length of the wireline in the borehole and/or the location of the well-tool in the borehole. The combination of the three measuring techniques may be robust because of, among other things, the passive/active agents may be configured beneath the armored layer of the wireline and may be impervious to inclement conditions in and around the borehole. The combination may also be accurate due to, among other things, the measurements from the passive/active agents may correct for errors in the measurements from the odometer wheels and may provide for locating optical gratings on the fiber optic and the time of flight measurements may correct for the stretch in the wireline.

While the principles of the invention have been described above in connection with specific apparatuses and methods, it is to be clearly understood that this description is made only by way of example and not as limitation on the scope of the invention.

What is claimed is:

1. A system for determining depth of a well-tool in a borehole penetrating an earth formation comprising:

a wireline configured to couple with said well-tool and to suspend said well-tool in the borehole;

a plurality of transponders disposed along the wireline at predetermined locations, wherein each of said predetermined locations define a measured length of the wireline;

a reader for reading the plurality of transponders, wherein the reader is configured to receive a signal from each of the plurality of transponders when each of said plurality of transponders is located at a read position relative to the reader;

a fiber optic cable coupled with the wireline, an optical signal generator coupled with the fiber optic cable and configured to generate an optical signal and transmit the optical signal through the fiber optic cable;

an optical detector coupled with the fiber optic cable and configured to detect the optical signal, wherein the optical signal generator and the optical detector are positioned at a predetermined distance from each other on the wireline; and a processor capable of communicating with the reader and configured to receive an output from the reader and to process the depth of the well-tool in the borehole from the output and a time of flight of the optical signal between the optical signal generator and the optical detector.

2. The system for determining depth of the well-tool in the borehole penetrating the earth formation as recited in claim 1, wherein each of the plurality of transponders stores identification data, and wherein the reader is configured to read the identification data stored on each of the plurality of transponders when each of said plurality of transponders is located at the read position.

3. The system for determining depth of the well-tool in the borehole penetrating the earth formation as recited in claim 1, wherein the measured length comprises a measured length of the wireline under a tension.

4. The system for determining depth of the well-tool in the borehole penetrating the earth formation as recited in claim 1, wherein the plurality of the transponders are disposed beneath an armor layer and said armor layer is configured to protect said transponders.

5. The system for determining depth of the well-tool in the borehole penetrating the earth formation as recited in claim 1, wherein the processor is configured to process tension effects of the well-tool on the wireline to process the well depth.

6. The system for determining depth of the well-tool in the borehole penetrating the earth formation as recited in claim 1, wherein the processor is configured to process temperature effects on the wireline to process the well depth.

7. The system for determining depth of the well-tool in the borehole penetrating the earth formation as recited in claim 2, further comprising:

an odometer wheel coupled with the processor and configured to provide that the wireline is in contact with the odometer wheel and causes the odometer wheel to rotate as the wireline is moved in and out of the borehole, wherein the odometer wheel is configured to communicate rotation data to the processor, and wherein the processor is configured to process the depth of the well-tool in the borehole from the identification data and the rotation data.

8. The system for determining depth of the well-tool in the borehole penetrating the earth formation as recited in claim 2, wherein the identification data stored on each of the plurality of transponders is unique.

9. The system for determining depth of the well-tool in the borehole penetrating the earth formation as recited in claim 2, wherein the identification data identifies a location on the wireline of each of the plurality of transponders.

10. The system for determining depth of the well-tool in the borehole penetrating the earth formation as recited in claim 1, wherein the predetermined locations are equally spaced along the wireline.

11. The system for determining depth of the well-tool in the borehole penetrating the earth formation as recited in claim 1, wherein the plurality of transponders comprise a plurality of RFID tags and the reader comprises a radio-frequency transceiver.

12. The system for determining depth of the well-tool in the borehole penetrating the earth formation as recited in claim 11, wherein the plurality of RFID tags comprise a plurality of passive RFID tags.

13. The system for determining depth of the well-tool in the borehole penetrating the earth formation as recited in claim 11, wherein the plurality of RFID tags comprise a plurality of active RFID tags.

14. A method for determining depth of a well-tool in a borehole penetrating an earth formation where the well-tool is suspended in the borehole from a wireline, comprising the steps of;

moving the wireline into the borehole to position the well-tool;

using a set of odometer wheels to measure length of the wireline moved into the borehole;

transmitting the length measured by the odometer wheels to a processor;

receiving at a receiving location data from at least one of a plurality of transponders passing the receiving location as the wireline is moved into the borehole, wherein the plurality of transponders are disposed at predetermined locations along the wireline;

transmitting the received data to the processor;

measuring a time of flight of an optical signal passing through a fiber optic cable coupled with the wireline; wherein;

the time of flight is measured between a first optical grating and a second optical grating, and wherein the first and second optical gratings are disposed along the fiber optic cable;

the first and the second optical gratings are disposed at predetermined distances along the wireline, and a first and a second transponder from the plurality of transponders are positioned at a same location as the first and the second optical gratings, respectively transmitting the time of flight to the processor; and processing the depth of the well-tool in the borehole penetrating an earth formation from the length measured by the odometer wheels, the data received from at least one of the plurality of transponders and the time of flight.

15. The method for determining depth of the well-tool in the borehole penetrating the earth formation where the well-tool is suspended in the borehole from a wireline as recited in claim 14, wherein the time of flight is measured along the fiber optic cable coupled with the wireline inside the borehole.

* * * * *